United States Patent [19]

Pomeroy

[11] Patent Number: 4,569,107

[45] Date of Patent: Feb. 11, 1986

[54] METHOD OF FORMING A WARP BEAM FOR A TEXTILE LOOM

[75] Inventor: William F. Pomeroy, Rocky Mount, N.C.

[73] Assignee: Texfi Industries, Inc., Greensboro, N.C.

[21] Appl. No.: 639,364

[22] Filed: Aug. 8, 1984

[51] Int. Cl.[4] ..... D02H 5/02

[52] U.S. Cl. ..... 28/184; 28/178; 8/477; 8/151.2

[58] Field of Search ..... 8/477, 151.2; 28/178, 28/184

[56] References Cited

U.S. PATENT DOCUMENTS

| | | | |
|---|---|---|---|
| 1,096,702 | 5/1914 | Fleischer et al. | 28/184 |
| 3,681,824 | 8/1972 | Yasuji | 28/184 X |
| 4,099,913 | 7/1978 | Walter et al. | 8/477 |
| 4,259,994 | 4/1984 | Hobson | 28/184 X |

FOREIGN PATENT DOCUMENTS

| | | | |
|---|---|---|---|
| 161841 | 3/1904 | Fed. Rep. of Germany | 28/184 |
| 2402353 | 7/1975 | Fed. Rep. of Germany | 8/477 |
| 441005 | 1/1936 | United Kingdom | 28/178 |

*Primary Examiner*—Robert R. Mackey

*Attorney, Agent, or Firm*—Bell, Seltzer, Park & Gibson

[57] ABSTRACT

A method is provided for forming a warp beam with warp yarns having a temporary coloration to permit ready visual identification of the warp yarns during subsequent handling of the warp beam. The temporary coloration is accomplished by applying a foamed fugitive tint to the warp yarns in their path of travel from a supply creel to a winder with their speed of travel being such that the yarns are dried without having to apply external heat.

7 Claims, 4 Drawing Figures

METHOD OF FORMING A WARP BEAM FOR A TEXTILE LOOM

FIELD OF THE INVENTION

This invention relates to a method of forming a warp beam for a textile loom with the warp yarns having a temporary coloration or tint for visual identification purposes. More particularly, this invention is directed to a method of forming a warp beam with warp yarns colored by applying a foamed fugitive tint to the warp yarns in their path of travel from a supply creel to the warp beam.

BACKGROUND OF THE INVENTION

It is often desirable in textile yarn handling and weaving operations to be able to readily identify particular yarns. For example, when a loom beam of yarns is made up of various yarns of different sizes or fiber types, applying distinguishing coloration to the composite yarns allows the beam to be readily inspected and further allows yarn "piece up" to be quickly accomplished in the event a particular yarn breaks during weaving. This coloration must be easily removable, however, so that it does not interfere with permanent dyeing.

In the past, this temporary coloration typically has been accomplished by directing the yarns through a bath containing a fugitive tint carried in a liquid transfer medium such as water. The yarns would take up and absorb the liquid along with the tint and thereafter be squeezed by rollers to remove a portion of the excess liquid. The yarns then had to be subjected to heat to fully remove the remaining liquid prior to weaving or other yarn handling.

This tinting was typically carried out on modified slasher apparatus which included a tint bath and drying means. Tinting could be so accomplished on the slasher even if the slasher was not being utilized to apply sizing composition. Tinting in this manner, however, presented several problems.

First of all, the yarns run through the bath retained a substantial amount of excess liquid that required a corresponding substantial amount of energy to heat and remove the undesired liquid. The amount of this wet pickup was about 70% to about 75% by weight. Furthermore, the yarns were so saturated by the tint bath that the tint penetrated into the yarn as well as coloring the exterior so that eventual tint removal prior to dyeing was made undesirably difficult.

In addition, applying tint utilizing slashing apparatus in this manner was relatively slow, at a yarn travel rate of only about 80 yards per minute, even when sizing was not being applied. This slow speed was necessary in order to carry out the drying required. And subjecting the yarn to this additional process and handling allowed the introduction of defects that would otherwise have been avoided. Finally, this bath form of tinting did not make the most effective use of the available tint since quantities of tint were lost and exhausted in the handling of the tint liquid.

Efforts were made by some yarn manufacturers at tinting yarns during the manufacture thereof and supplying them in tinted form to fabric manufacturers but the efforts have not been satisfactory. The yarns so produced have been limited in coloration and the tinting itself has been spotty and nonuniform.

SUMMARY OF THE INVENTION

It is accordingly an object of the present invention to provide a method of forming a warp beam with the warp yarns having a temporary coloration for identification purposes wherein the coloration is accomplished by applying a foamed fugitive tint to the warp yarns as they pass from yarn packages in a creel to a warp beam at a warp winding station. The tinted yarns are directed from the creel to the warp beam at such speed that they are dried prior to being wound onto the warp beam so that it is unnecesssary to apply external heat to effect drying. Warp beams comprised of these colored yarns can be combined with warp beams comprised of uncolored yarns to form a striped loom beam of colored and uncolored warp yarns.

The speed of travel of the warp yarns being tinted is desirably at least about 500 yards per minute and is such a speed that the tinting and warping can be carried out in substantially the same length of time usually required for warping alone.

Furthermore, by applying the tint in foamed form a minimum of moisture is imparted to the yarns. Desirably, a maximum of only about 5 weight percent moisture is picked up by the warp yarns when the foamed tint is applied thereto. This moisture is then quickly removed from the yarns, desirably in less than three seconds after application of the foamed tint.

BRIEF DESCRIPTION OF THE DRAWINGS

Further and more specific features and advantages of the invention will become more apparent when taken in connection with the accompanying drawings, in which—

DETAILED DESCRIPTION OF THE ILLUSTRATED EMBODIMENT

While the present invention will be described more fully hereinafter with reference to the accompanying drawings, in which a particular form of carrying out the present invention is shown, it is to be understood at the outset of the description which follows that persons of skill in the appropriate arts may modify the form of the invention here described while still achieving the favorable results of this invention. Accordingly, the description which follows is to be understood as being a broad, teaching disclosure directed to persons of skill in the appropriate arts, and not as limiting upon the present invention.

Figure 1:
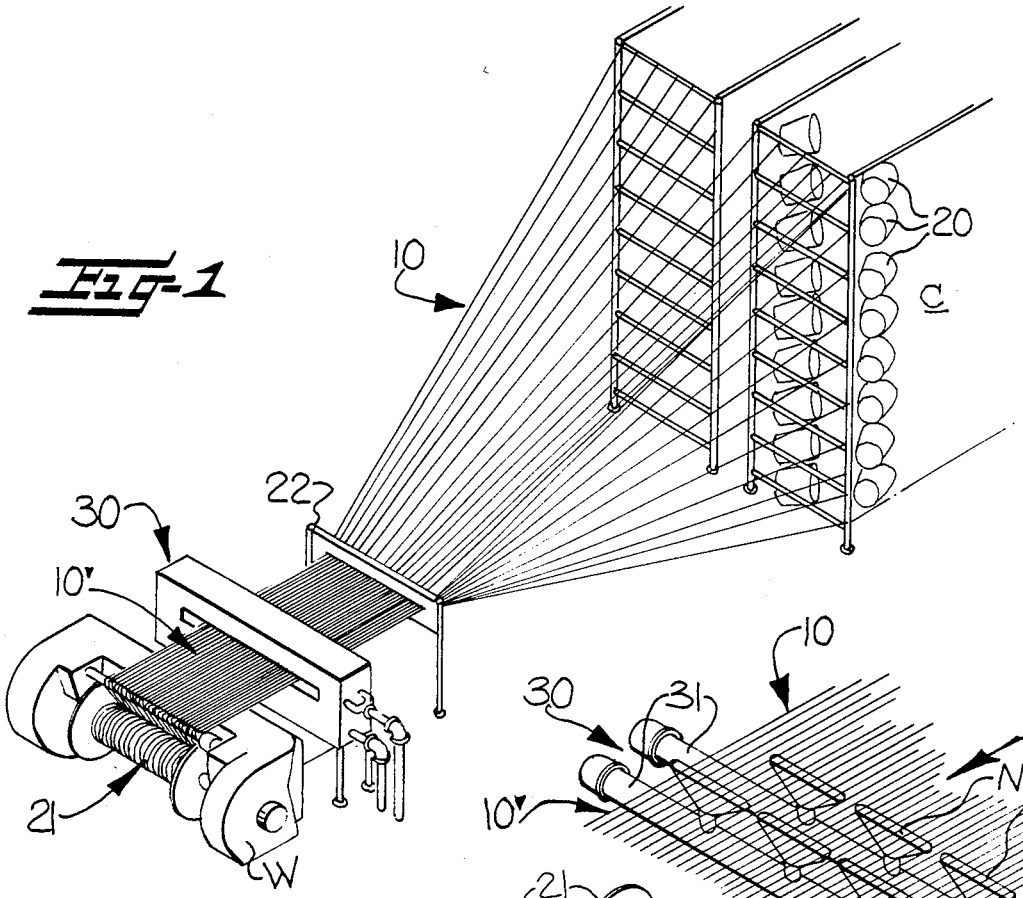
FIG. 1 is an environmental view in partially schematic form illustrating generally how the method of the invention can be carried out.

Referring now more specifically to the drawings, FIG. 1 generally illustrates apparatus being utilized to carry out the method of the invention. Generally, a plurality of yarns 10 are directed from a plurality of yarn packages 20 held in a creel C onto a warp beam 21 at a warp winding station W. Typically, some 500 yarn ends are so handled.

Figure 2:
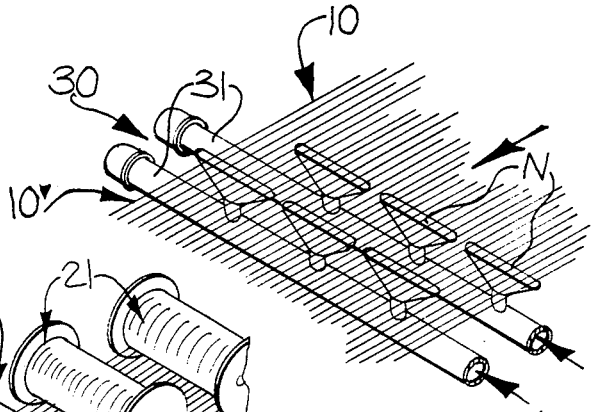
FIG. 2 is a partial perspective view of tinting apparatus.
Figure 3:
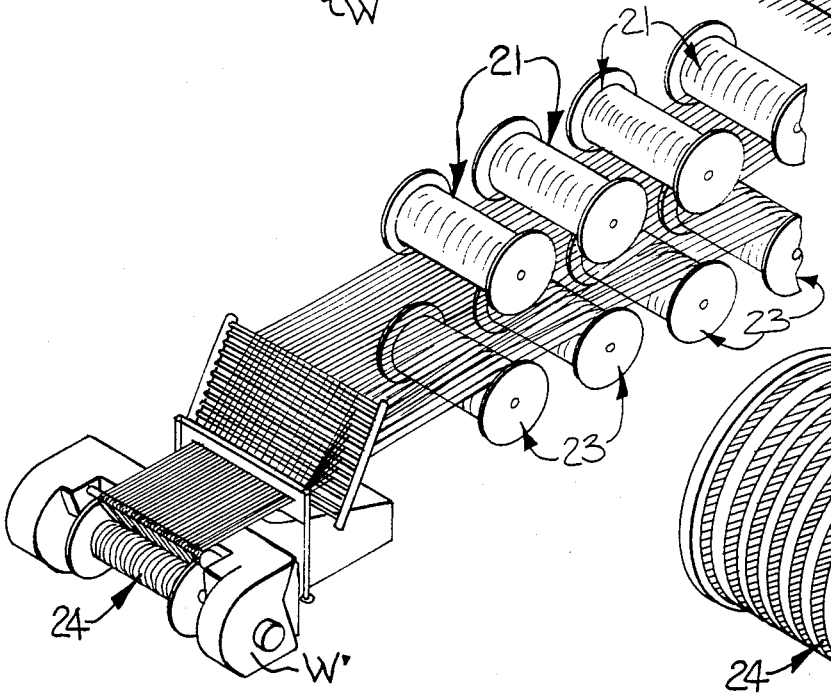
FIG. 3 is a partial perspective view illustrating colored and uncolored warp beams being combined to form a loom beam.
Figure 4:
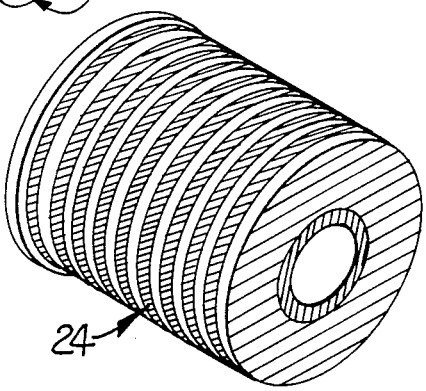
FIG. 4 is a loom beam comprised of colored and uncolored warps.

Between the creel C and the warp winding station or warper W, there are desirably included warp yarn guides and spacers in the form of an adjustable comb 22 for receiving the bank of yarns 10 supplied from a plurality of spaced apart locations in the creel C and for maintaining the yarns in a predetermined spacing and arrangement. Once so arranged, as shown in FIGS. 1 and 2, the yarns 10 are directed through tinting station 30 wherein, for example, tint may be supplied from a staggered bank of nozzles N connected to supply pipes 31. The tint is applied to the exterior of yarns 10 to produce temporarily colored yarns 10'. The colored yarns 10' are then wound onto warp beam 21. Warp beam 21 may then be taken directly to a loom for weaving or, as shown in FIG. 3, may be combined with other warp beams 23, typically uncolored, to form a composite loom beam 24. Loom beam 24 has spaced apart bands of color thereon comprised of the colored yarns 10' that along with uncolored warp yarns 10 form a striped loom beam 24 of warp yarns.

The invention thus includes the method of forming a warp beam 21 with the warp yarns 10' having a temporary coloration and includes the steps of arranging a predetermined number of packages 20 of warp yarns in a creel C associated with a warp beam winding station W and directing the warp yarns 10 from the creel C onto a warp beam 21 at the warp winding station W at a predetermined speed while maintaining the warp yarns 10 in spaced apart relation in their path of travel.

A foamed fugitive tint is applied to the warp yarns 10 at tinting station 30 located in the path of travel of said yarns 10 from the creel C to the winding station W. Tint is foamed with a gas such as air and is applied in this form with only a small amount of liquid present so that the moisture picked up by the colored yarns 10' is no greater than about 5 weight percent. Tint is a fugitive tint in that it provides a temporary coloration to the yarn that may be readily removed in boil off or scouring prior to fabric finishing and dyeing. Tints marketed by Milliken Chemicals under the trademark Versatint are available in a wide variety of types and colors suitable for such use. These foamed tints can be applied so as to effectively color the entire surface of the yarns while not saturating same to thereby make tint removal relatively easy.

The colored yarns 10' are moved along their path of travel at such a predetermined speed of travel that drying of the yarns 10' is accomplished prior to the yarns being wound onto the warp beam 21. This avoids the necessity of applying any external heat which would be needed to remove excess moisture. This speed of travel is desirably at least about 500 yards per minute and preferably is at least about 850 yards per minute. Traveling freely at such speeds through ambient air at about 75° F. and about 50% relative humidity produces wafting air currents and results in substantially all of the moisture picked up by the warp yarns 10' when the foamed tint is applied thereto being removed therefrom in less than three seconds after such application. And as mentioned above and as shown in FIG. 3, if desired, a plurality of warp beams 21 so comprised of colored warp yarns 10' may be arranged behind another winding station W' together with other warp beams 23 of different appearance, typically uncolored, and directed onto a loom beam while arranging the yarns being wound in spaced apart bands of color to form a striped loom beam 24 of warp yarns. Usually, these bands of color are comprised of substantially the same number of colored warp yarns arranged in substantially regular spacing across the loom beam 24 to form colored bands of substantially equal width and regular spacing.

In the drawings and specifications, there have been disclosed typical preferred embodiments of the invention, and although specific terms are employed, they are used in a generic and descriptive sense only and not for purposes of limitation.

That which I claim is:

1. A method of forming a warp beam with the warp yarns having temporary coloration to readily permit visual indentification of the warp yarns during subsequent handling of the warp beam and the weaving of the yarns therefrom into cloth, said method comprising the steps of:

arranging a predetermined number of packages of warp yarns in a creel associated with a warp beam winding station;

directing the warp yarns from the creel onto a warp beam at the warp winding station at a predetermined high speed while maintaining the warp yarns in spaced apart relation in their path of travel; and applying a foamed fugitive tint to the warp yarns in their path of travel from the creel to the winding station with said tint including a minimum amount of liquid so that moisture pick-up by said yarns is no greater than a predetermined amount, said predetermined speed of travel of said yarns being such and said moisture pick-up being such as to effect drying of the yarns traveling freely through ambient air by the generation of wafting air currents prior to their being wound onto the warp beam to thereby avoid the necessity of applying external heat to dry the yarns.

2. The method of claim 1 wherein the predetermined speed of travel of the yarns being colored by the foamed tint is at least about 500 yards per minute.

3. The method of claim 1 wherein a maximum of about 5 weight percent moisture is picked up by the warp yarns when the foamed tint is applied thereto.

4. The method of claim 3 wherein the warp yarns are directed from the creel to the warp beam at such a predetermined speed of travel that substantially all of the moisture picked up by the warp yarns when the foamed tint is applied thereto is removed therefrom in less than three seconds after such application.

5. A method of forming a warp beam with the warp yarns having a temporary coloration to readily permit visual identification of the warp yarns during subsequent handling of the warp beam and the weaving of the yarns therefrom into cloth, said method comprising the steps of:

arranging a predetermined number of packages of warp yarns in a creel associated with a warp beam winding station;

directing the warp yarns from the creel onto a warp beam at the warp winding station at a predetermined speed of at least about 500 yards per minute while maintaining the warp yarns in spaced apart relation in their path of travel; and applying a foamed fugitive tint to the warp yarns in their path of travel from the creel to the winding station with the warp yarns picking up a maximum of about 5 weight percent moisture from the tint during such application, and said predetermined speed of travel of said yarns being such as to effect drying of the yarns prior to their being wound onto the warp beam to thereby avoid the necessity of applying external heat to dry the yarns.

6. A method of forming a loom beam with the warp yarns thereof arranged in spaced apart bands of color, to readily permit visual indentification of the warp yarns during subsequent handling of the warp beam and the weaving of the yarns therefrom into cloth, said method comprising the steps of:

arranging a predetermined number of packages of warp yarns in a creel associated with a warp beam winding station;

directing the warp yarns from the creel onto a warp beam at the warp winding station at a predetermined high speed while maintaining the warp yarns in spaced apart relation in their path of travel;

applying a foamed fugitive tint to the warp yarns in their path of travel from the creel to the winding station with said tint including a minimum amount of liquid so that the moisture pick-up by said yarns is no greater than a predetermined amount, said predetermined speed of travel of said yarns being such and said moisture pick-up being such as to effect drying of the yarns traveling freely through ambient air by the generation of wafting air currents prior to their being wound onto the warp beam to thereby avoid the necessity of applying external heat to dry the yarns;

arranging a plurality of the thus wound and tinted warp beams behind another winding station together with warp beams of uncolored yarns; and directing the warp yarns from the tinted warp beams and the warp yarns from uncolored beams onto a loom beam while arranging the yarns being wound in spaced apart bands of color to form a striped loom beam of warp yarns.

7. The method of claim 6 wherein each of the bandsof color in the loom beam are comprised of substantially the same number of colored warp yarns and are arranged in substantially regular spacing across the loom beam to form colored bands of substantially equal width and spacing.

* * * * *